US006059054A

United States Patent [19]

Portwood et al.

[11] Patent Number: 6,059,054

[45] **Date of Patent: *May 9, 2000**

[54] NON-SYMMETRICAL STRESS-RESISTANT ROTARY DRILL BIT CUTTER ELEMENT

[75] Inventors: Gary Ray Portwood, Kingwood; Gary Edward Garcia, The Woodlands; James Carl Minikus, Spring; Per Ivar Nese, Houston; Chris Edward Cawthorne, The Woodlands; Scott D. McDonough, Houston, all of Tex.

[73] Assignee: Smith International, Inc., Houston, Tex.

[ * ] Notice: This patent is subject to a terminal disclaimer.

[21] Appl. No.: 08/879,872

[22] Filed: Jun. 20, 1997

Related U.S. Application Data

[60] Provisional application No. 60/020,198, Jun. 21, 1996.

[51] Int. Cl.[7] ..... E21B 10/08

[52] U.S. Cl. ..... 175/430; 175/431

[58] Field of Search ..... 175/374, 431, 175/430, 378, 398

[56] References Cited

U.S. PATENT DOCUMENTS

| | | | |
|---|---|---|---|
| 4,058,177 | 11/1977 | Langford, Jr. et al. | 175/374 |
| 4,108,260 | 8/1978 | Bozarth | 175/374 |
| 4,334,586 | 6/1982 | Schumacher | 175/374 |
| 4,722,405 | 2/1988 | Langford, Jr. | 175/374 |
| 5,201,376 | 4/1993 | Williams | 175/374 |
| 5,322,138 | 6/1994 | Siracki | 175/374 |
| 5,407,022 | 4/1995 | Scott et al. | 175/431 X |
| 5,421,423 | 6/1995 | Huffstutler | 175/374 |
| 5,592,995 | 1/1997 | Scott et al. | 175/431 X |
| 5,746,280 | 5/1998 | Scott et al. | 175/374 |
| 5,813,485 | 9/1998 | Portwood | 175/430 |
| 5,839,526 | 11/1998 | Cisneros et al. | 175/431 |

*Primary Examiner*—Frank Tsay

[57] ABSTRACT

A cutter element that balances maximum gage-keeping capabilities with minimal tensile stress induced damage to the cutter elements is disclosed. The cutter elements of the present invention have a non-symmetrical shape and may include a more aggressive cutting profile than conventional cutter elements. In one embodiment, a cutter element is configured such that the inside angle at which its leading face intersects the wear face is less than the inside angle at which its trailing face intersects the wear face. This can also be accomplished by providing the cutter element with a relieved wear face. In another embodiment of the invention, the surfaces of the present cutter element are curvilinear and the transitions between the leading and trailing faces and the gage face are rounded, or contoured. In this embodiment, the leading transition is made sharper than the trailing transition by configuring it such that the leading transition has a smaller radius of curvature than the radius of curvature of the trailing transition. In another embodiment, the cutter element has a chamfered trailing edge such that the leading transition of the cutter element is sharper than its trailing transition. In another embodiment, the cutter element has a chamfered or contoured trailing edge in combination with a canted wear face. In still another embodiment, the cutter element includes a positive rake angle on its leading edge.

57 Claims, 15 Drawing Sheets

FIG. 12(iii)
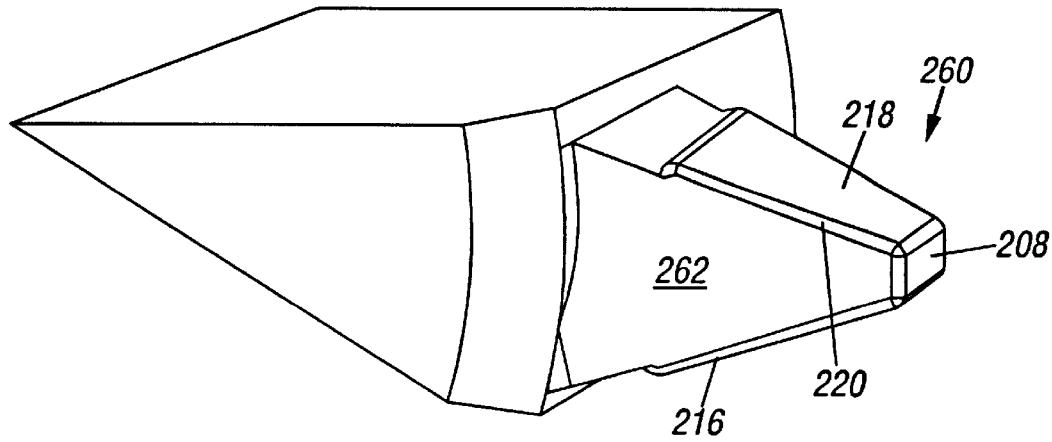

FIG. 13(iii)
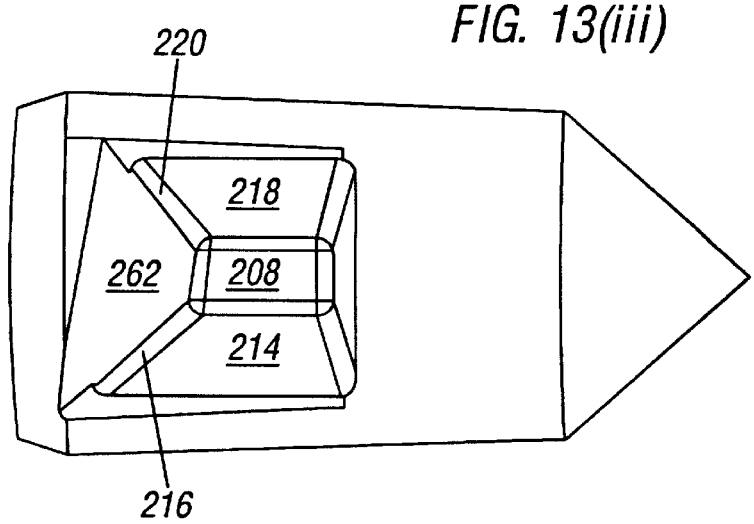

NON-SYMMETRICAL STRESS-RESISTANT ROTARY DRILL BIT CUTTER ELEMENT

CROSS REFERENCE TO RELATED APPLICATIONS

The present application claims the benefit of 35 U.S.C. 111(b) provisional application Ser. No. 60/020,198 filed Jun. 21, 1996, and entitled Non-Symmetrical Stress-Resistant Rotary Drill Bit Cutter Element.

STATEMENT REGARDING FEDERALLY SPONSORED RESEARCH OR DEVELOPMENT

Not applicable.

FIELD OF THE INVENTION

The invention relates generally to earth-boring bits used to drill a borehole for the ultimate recovery of oil, gas or minerals. More particularly, the invention relates to rolling cone rock bits and to an improved cutting structure for such bits. Still more particularly, the invention relates to a cutter element having a leading, borehole-engaging section that has a different geometry than its trailing section.

BACKGROUND OF THE INVENTION

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones. Such bits typically include a bit body with a plurality of journal segment legs. The cutters are mounted on bearing pin shafts that extend downwardly and inwardly from the journal segment legs. The borehole is formed as the gouging and scraping or crushing and chipping action of the rotary cones remove chips of formation material which are carried upward and out of the borehole by drilling fluid which is pumped downwardly through the drill pipe and out of the bit.

The earth disintegrating action of the rolling cone cutters is enhanced by providing the cutters with a plurality of cutter elements. Cutter elements are generally of two types: inserts formed of a very hard material, such as cemented tungsten carbide, that are press fit into undersized apertures in the cone surface; or teeth that are milled, cast or otherwise integrally formed from the material of the rolling cone. Bits having cemented tungsten carbide inserts are typically referred to as "TCI" bits, while those having teeth formed from the cone material are known as "steel tooth bits." The cutting surfaces of inserts are, in some instances, coated with a very hard "superabrasive" coating such as polycrystalline diamond (PCD) or cubic boron nitride (PCBN). Superabrasive materials are significantly harder than cemented tungsten carbide. As used herein, the term "superabrasive" means a material having a hardness of at least 2,700 Knoop (kg/mm$^2$). PCD grades have a hardness range of about 5,000–8,000 Knoop, while PCBN grades have a hardness range of about 2,700–3,500 Knoop. By way of comparison, a typical cemented tungsten carbide grade used to form cutter elements has a hardness of about 1475 Knoop.

Similarly, the teeth of steel tooth bits may be coated with a hard metal layer generally referred to as hardfacing. In each case, the cutter elements on the rotating cutters functionally breakup the formation to create new borehole by a combination of gouging and scraping or chipping and crushing.

The cost of drilling a borehole is proportional to the length of time it takes to drill to the desired depth and location. In oil and gas drilling, the time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its rate of penetration ("ROP"), as well as its durability or ability to maintain an acceptable ROP. As is apparent, dull, broken or worn cutter elements cause a decrease in ROP. The form and positioning of the cutter elements (both steel teeth and TCI inserts) upon the cutters greatly impact bit durability and ROP and thus are critical to the success of a particular bit design.

Bit durability is, in part, measured by a bit's ability to "hold gage," meaning its ability to maintain a full gage borehole diameter over the entire length of the borehole. Gage holding ability is particularly vital in directional drilling applications, which have become increasingly important. If gage is not maintained at a relatively constant dimension, it becomes more difficult, and thus more costly, to insert drilling apparatus into the borehole than if the borehole had a constant diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. This unnecessary wear will shorten the bit life of the newly-inserted bit, thus prematurely requiring the time consuming and expensive process of removing the drill string, replacing the worn bit, and reinstalling another new bit downhole.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP and increased loading on the other cutter elements on the bit. It may also accelerate wear of the cutter bearing and ultimately lead to bit failure.

In addition to the heel row inserts, conventional bits typically include a gage row of cutter elements mounted adjacent to the heel surface but oriented and sized in such a manner so as to cut the corner of the borehole. Conventional bits also include a number of additional rows of cutter elements that are located on the cones in rows disposed radially inward from the gage row. These cutter elements are sized and configured for cutting the bottom of the borehole and are typically described as inner row cutter elements.

Each cutter element on the bit has what is termed a leading face or edge and a trailing face or edge. The leading face or edge is defined as that portion of the cutting surface of the cutter element that first contacts the formation as the bit rotates. The trailing face or edge is the portion of the cutter opposite the leading face or edge. The terms "leading" and "trailing" will be used hereinafter to refer to these portions respectively, regardless of whether the section so referred to is planar, contoured or includes an edge. Because the precise portion of the cutter element meeting each definition varies not only with bit design and cutter element design, but also with movement of the rolling cone, it will be understood by those skilled in the art that the terms "leading" and "trailing" are functional and are each meant to be defined in terms of the operation of the drill bit and cutter element itself.

It has been found that the trailing section of each cutter element is generally subject to earlier failure than the leading section. It is believed that premature failure of the trailing section, and ultimately of the whole cutter, is the result of excessive friction along the trailing section and of the resultant tensile stresses in the direction of cutting movement. Unlike the leading section, the trailing section of the cutter does not engage in shearing or reaming of the borehole wall and is not subject to large compressive stresses in the direction of cutting movement. Inserts coated with superabrasive materials, such as PDC and PCBN, are also adversely affected by the same resultant tensile stress. Because diamond is relatively brittle, diamond coating tends to crack and break off, leaving the insert unprotected. Diamond coated inserts are better suited to withstand wear and frictional heat compared to uncoated inserts.

SUMMARY OF THE INVENTION

Thus, it is an object of the present invention to provide a gage row cutter element that balances maximum gage-keeping capabilities with minimal damage to the gage row cutter elements. The present invention reduces potentially damaging tensile stresses in the cutter element during drilling by providing a relieved and/or better-supported trailing section. The cutter elements are useful primarily in the gage row, but may also be used in other rows as well. The cutter elements of the present invention have a non-symmetrical shape and may include a more aggressive cutting profile than conventional cutter elements. It is a further object of the present invention to provide a cutter element that balances an aggressive cutting edge with adequate support for the cutting edge. By providing a trailing edge that is better able to withstand tensile stress in the direction of cutting movement, the overall life of both the cutter element and the drill bit are improved. This enables the cutter elements to withstand longer use, and enhances ROP, bit durability and footage drilled at full gage.

According to the invention, the cutter elements may be hard metal cutter elements with or without superabrasive coatings; having cutting portions attached to generally cylindrical base portions which are mounted in the cone cutter, or may comprise steel teeth that are milled, cast, or otherwise integrally formed from the cone material.

The present invention further provides an earth boring bit for drilling a borehole of a predetermined gage, the bit providing increased durability, ROP and footage drilled (at full gage) as compared with similar bits of conventional technology. The bit includes a bit body and one or more rolling cone cutters rotatably mounted on the bit body. The rolling cone cutter includes a generally conical surface, an adjacent heel surface, and preferably a circumferential shoulder therebetween. Each of the heel, conical and shoulder surfaces may support a plurality of cutter elements that are adapted to cut into the formation so as to produce the desired borehole.

In one embodiment of the present invention, a cutter element is formed having a wear face and substantially planar leading and trailing faces, each of which intersect the wear face of the cutter element at a transition or edge. The cutter element further includes a crest between the leading and trailing faces. The cutter element is configured in accordance with the principles of the present invention such that the inside angle at which the leading face intersects the wear face is less than the inside angle at which the trailing face intersects the wear face.

In another embodiment of the invention, the surfaces of the present cutter element are curvilinear and the transitions between the leading and trailing faces and the wear face are rounded, or contoured. In this embodiment, the leading transition is made sharper than the trailing transition by configuring it such that the leading transition has a smaller radius of curvature than the radius of curvature of the trailing transition.

In another embodiment, the cutter element has a chamfered trailing edge such that the leading transition of the cutter element is sharper than its trailing transition. In another embodiment, the cutter element has a chamfered or contoured trailing edge in combination with a canted or relieved wear face. In still another embodiment, the cutter element includes a positive rake angle on its leading edge.

In a preferred embodiment of the invention, the outer surfaces of the present cutter element are sculpted and the transitions between the leading and trailing faces and the wear face are rounded, or contoured. In this preferred embodiment, the leading transition is sharper than the trailing transition, the trailing transition is obtuse, the trailing face is extremely rounded, and the wear face is relieved, resulting in an extremely nonsymmetrical cutter element.

BRIEF DESCRIPTION OF THE DRAWINGS

For an introduction to the detailed description of the preferred embodiments of the invention, reference will now be made to the accompanying drawings, wherein:

FIG. 11A is a cross-sectional view of a conventional prior art cutter element in an as-new condition, such as that depicted in FIGS. 3A–3D;

FIG. 11B is a cross-sectional view of the cutter element of FIGS. 5A–5D;

FIG. 11C is a cross-sectional view of the cutter element of FIGS. 7A–7D;

FIG. 11D is a cross-sectional view of the preferred cutter element of FIGS. 9A–D; and FIGS. 11E–H are cross-sectional views of additional alternative embodiments of the present cutter element in an as-new condition;

DETAILED DESCRIPTION OF THE PREFERRED EMBODIMENTS

Figure 1:
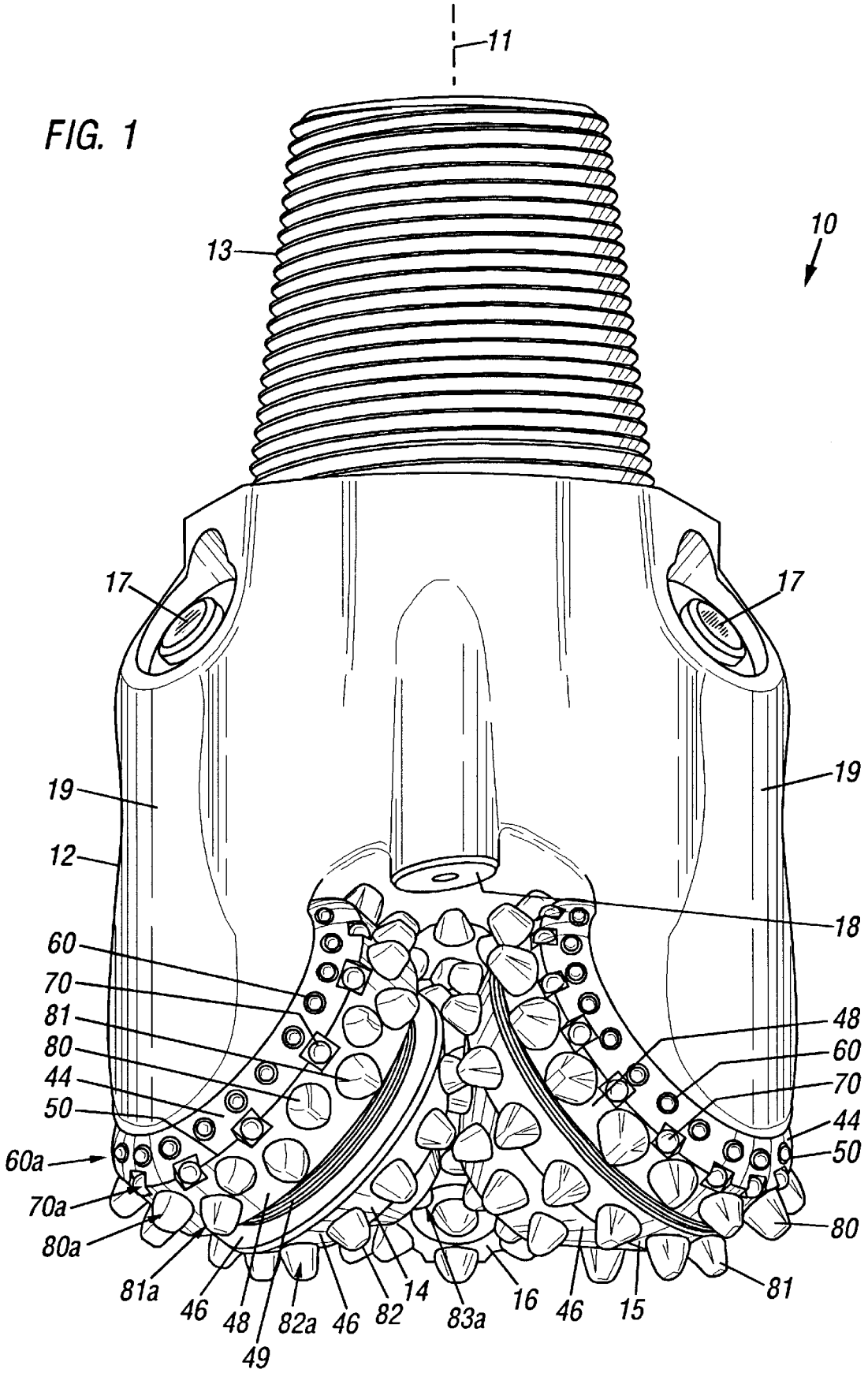
FIG. 1 is a perspective view of an earth boring bit having cutter elements made in accordance with the present invention.

Referring first to FIG. 1, an earth-boring bit 10 made in accordance with the present invention includes a central axis 11 and a bit body 12 having a threaded section 13 on its upper end for securing the bit to the drill string (not shown). Bit 10 has a predetermined gage diameter as defined by three rolling cone cutters 14, 15, 16 rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cutters 14–16. Bit 10 further includes lubricant reservoirs 17 that supply lubricant to the bearings of each of the cutters.

Figure 2:
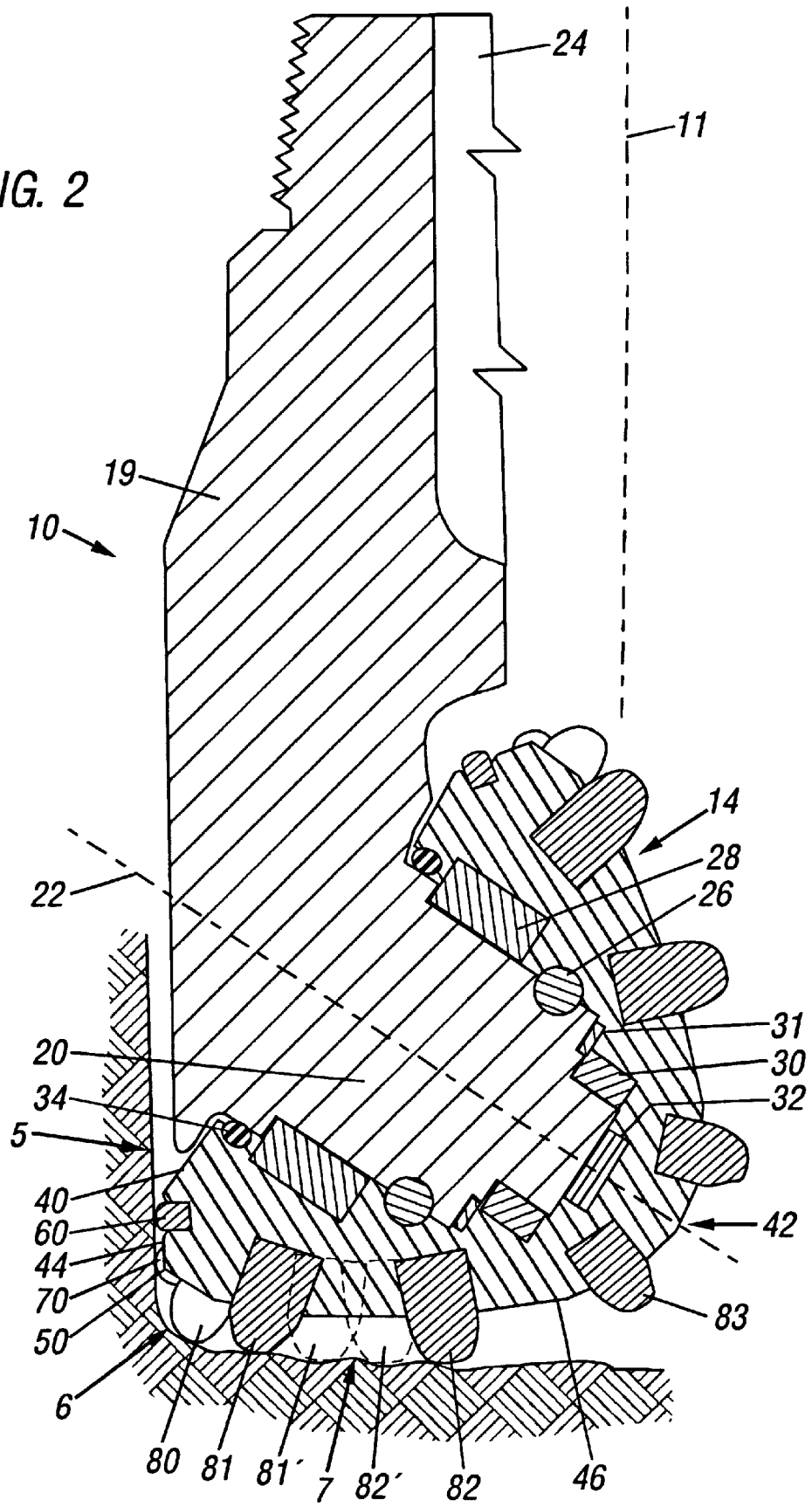
FIG. 2 is a partial section view taken through one leg and one rolling cone cutter of the bit shown in FIG. 1.
Figure 3A:
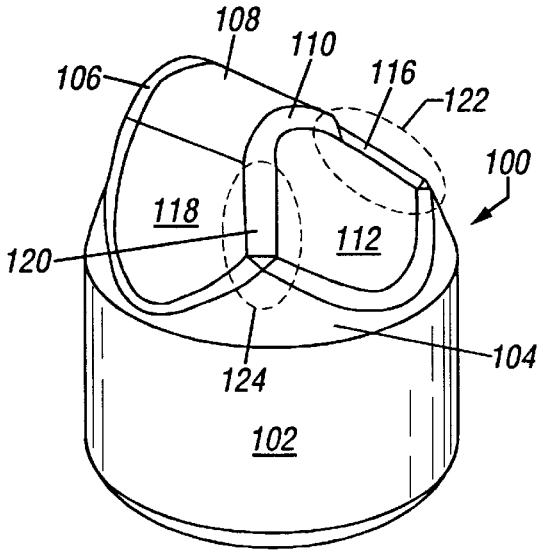
FIG. 3A (Prior Art)
FIGS. 3A–D are perspective, plan, side and front views, respectively, of a prior art standard cutter element in an as-new condition.
Figure 3B:
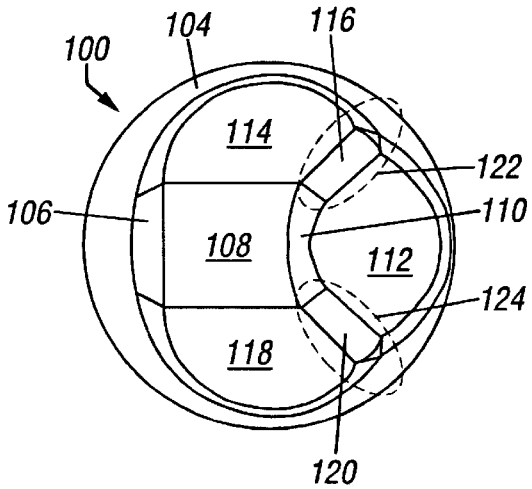
FIG. 3B (Prior Art)
Figure 3C:
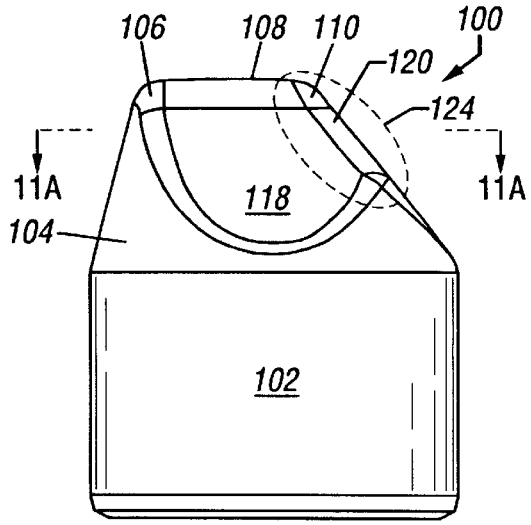
FIG. 3C (Prior Art)
Figure 3D:
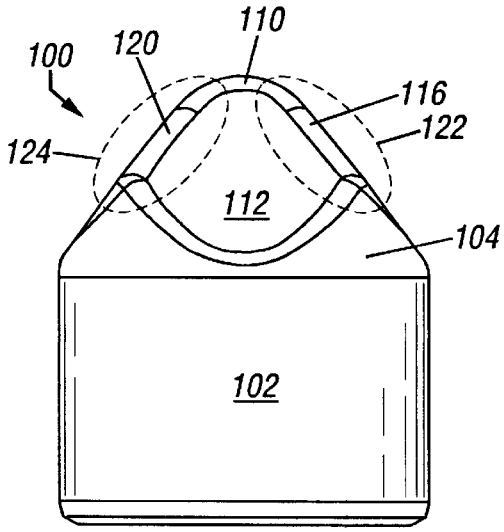
FIG. 3D (Prior Art)
Figure 4A:
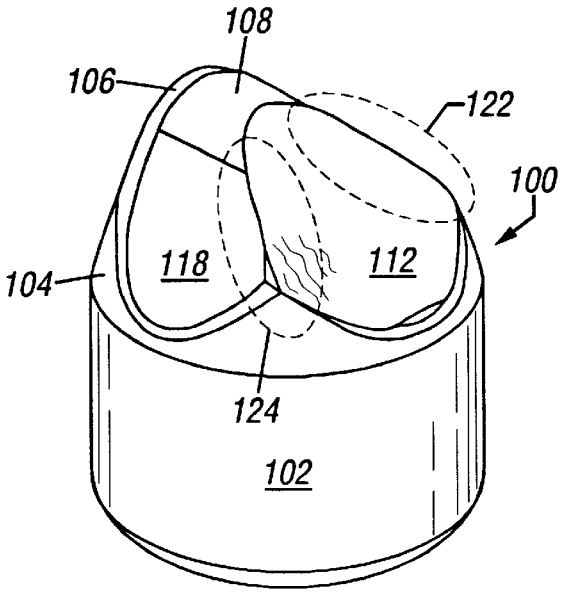
FIG. 4A (Prior Art)
FIGS. 4A–D are perspective, plan, side and front views, respectively, of the prior art standard cutter element of FIGS. 3A–D in a worn condition.
Figure 4B:
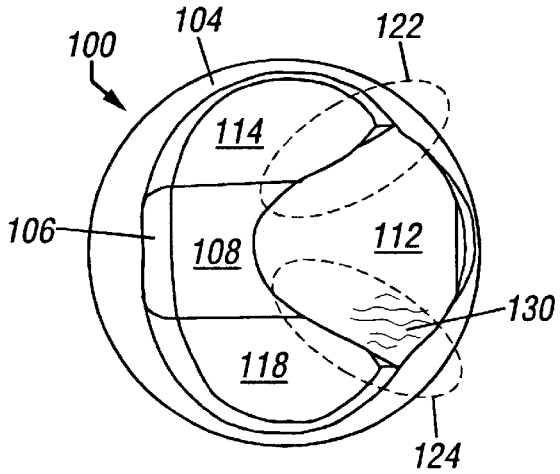
FIG. 4B (Prior Art)
Figure 4C:
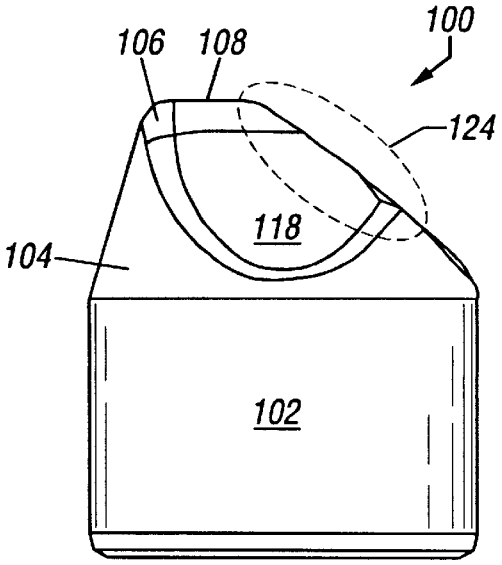
FIG. 4C (Prior Art)
Figure 4D:
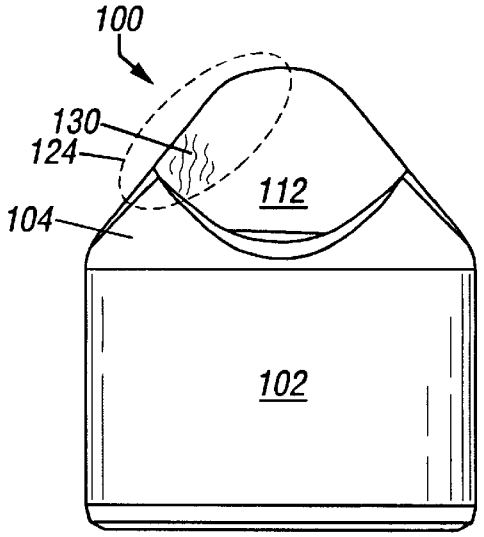
FIG. 4D (Prior Art)
Figure 5A:
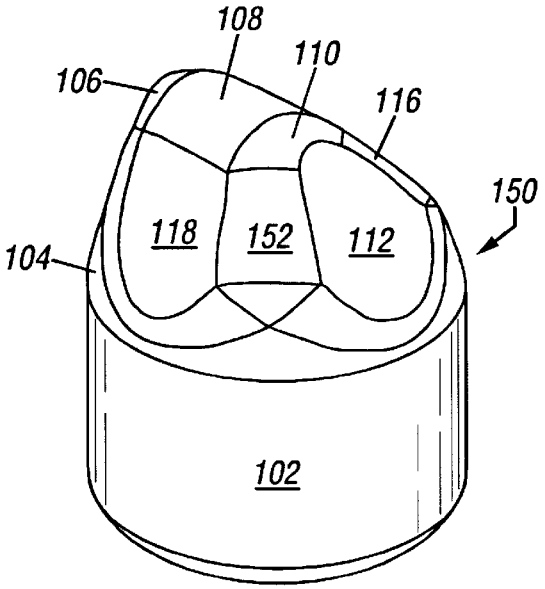
FIG. 5A is a perspective view of an exemplary cutter element fashioned in accordance with a first embodiment of the present invention and shown in an as-new condition.
Figure 5B:
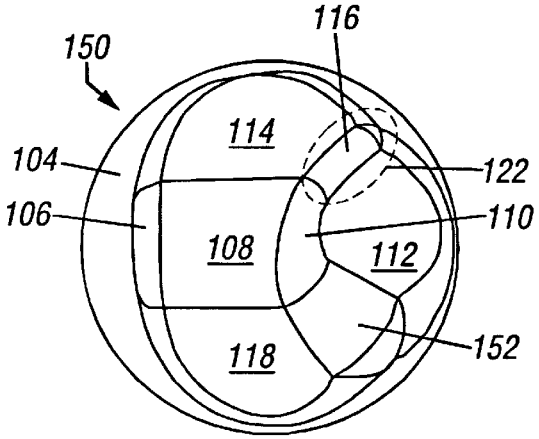
FIGS. 5B–D are plan, side and front views, respectively, of the cutter element of FIG. 5A.
Figure 5C:
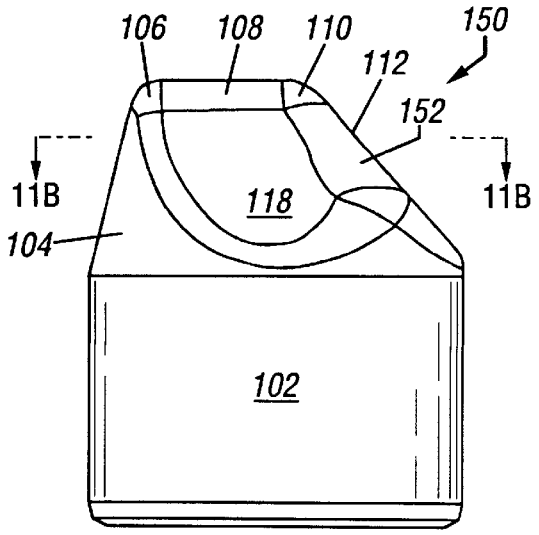
Figure 5D:
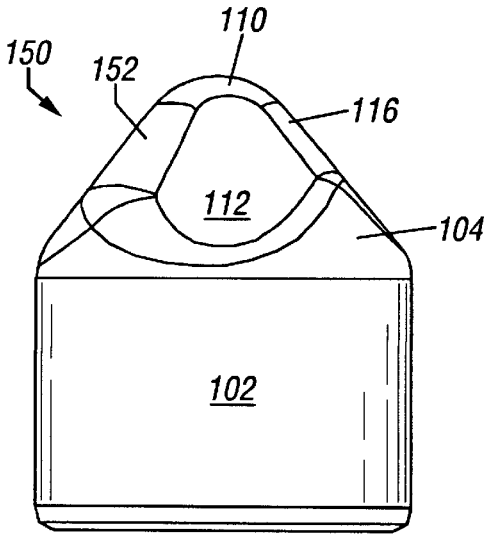
Figure 6A:
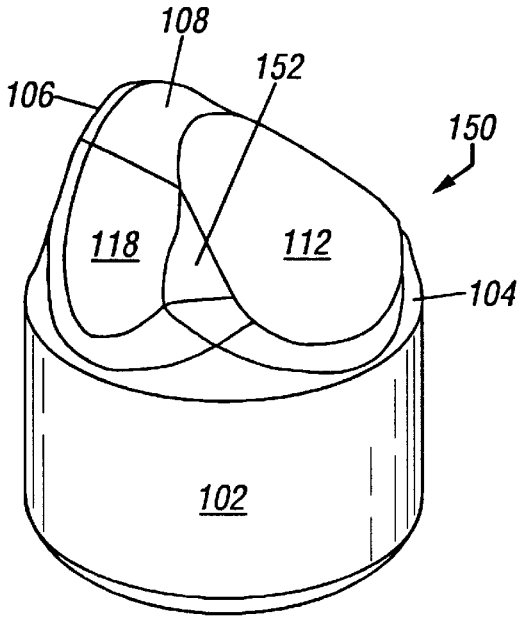
FIGS. 6A–D are perspective, plan, side and front views, respectively, of the cutter element of FIGS. 5A–D in a worn condition.
Figure 6B:
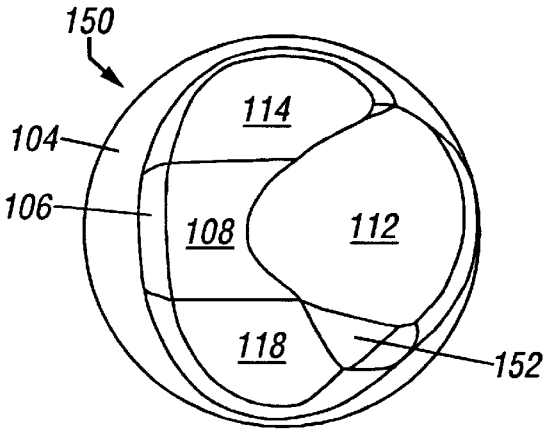
Figure 6C:
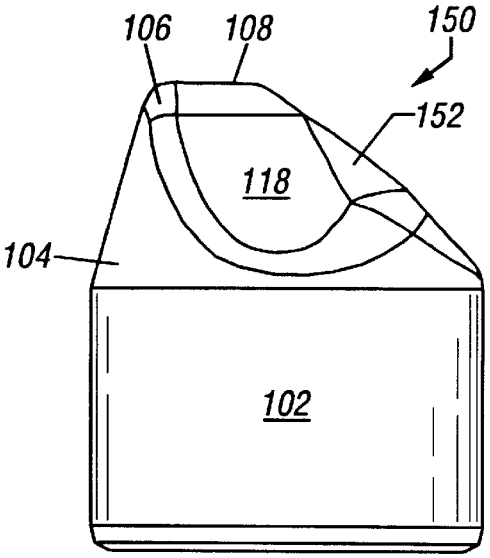
Figure 6D:
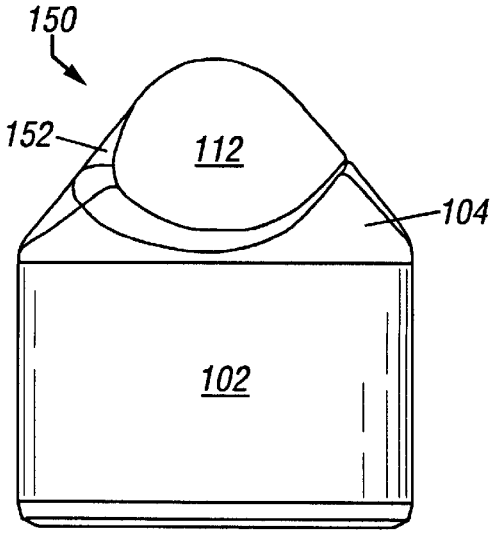
Figure 7A:
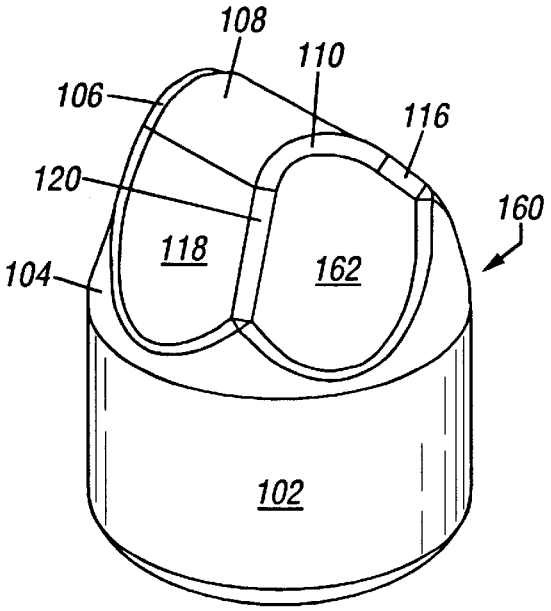
FIG. 7A is a perspective view of an exemplary cutter element fashioned in accordance with a second embodiment of the present invention and shown in an as-new condition.
Figure 7B:
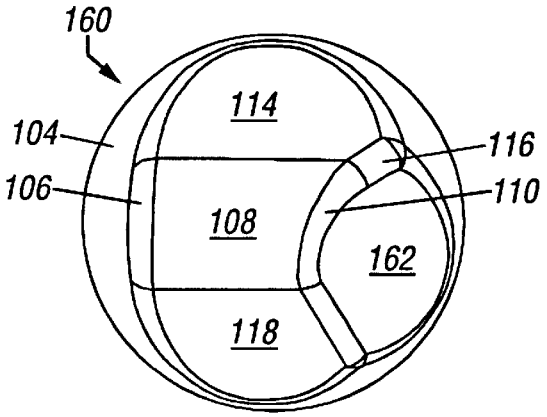
FIGS. 7B–D are plan, side and front views, respectively, of the cutter element of FIG. 7A.
Figure 7C:
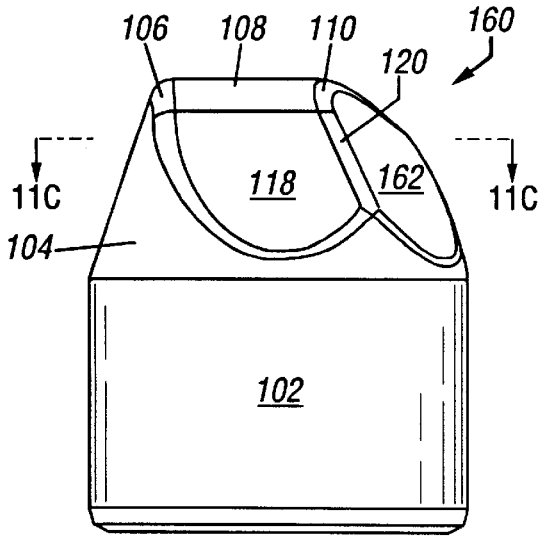
Figure 7D:
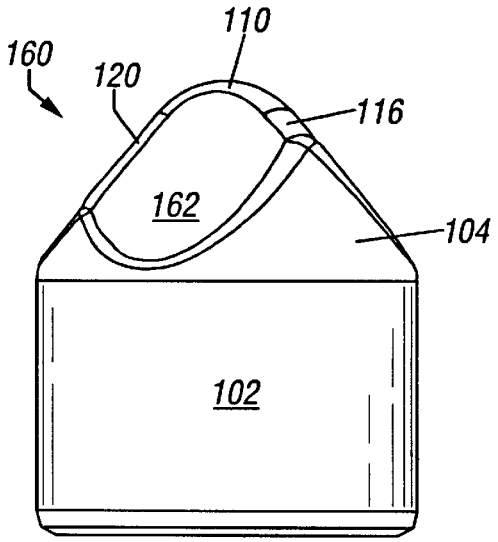
Figure 8A:
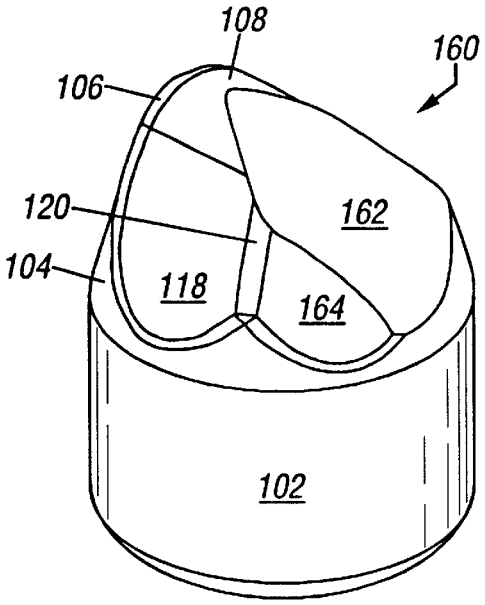
FIGS. 8A–D are perspective, plan, side and front views, respectively, of the cutter element of FIGS. 7A–D in a worn condition.
Figure 8B:
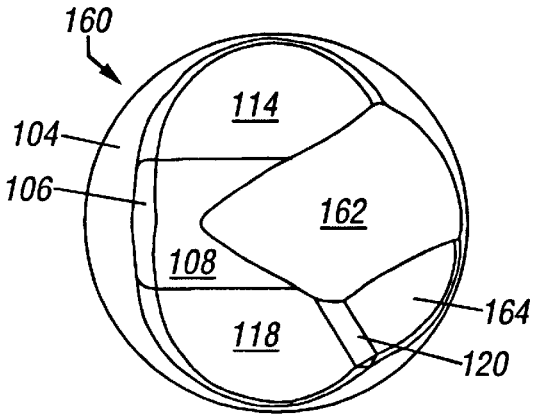
Figure 8C:
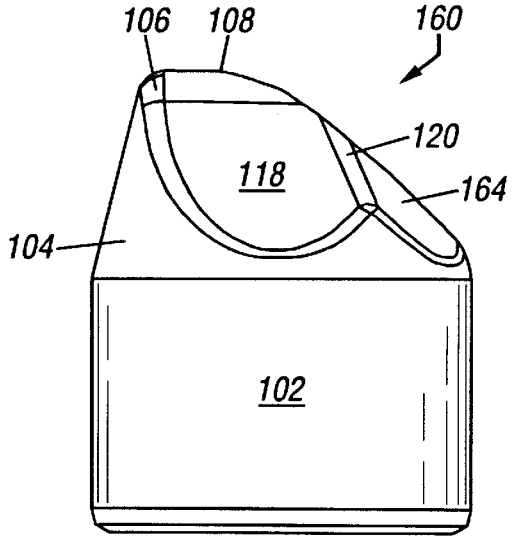
Figure 8D:
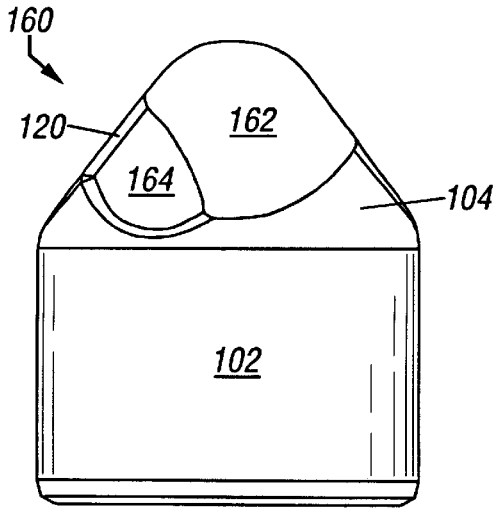
Figure 9A:
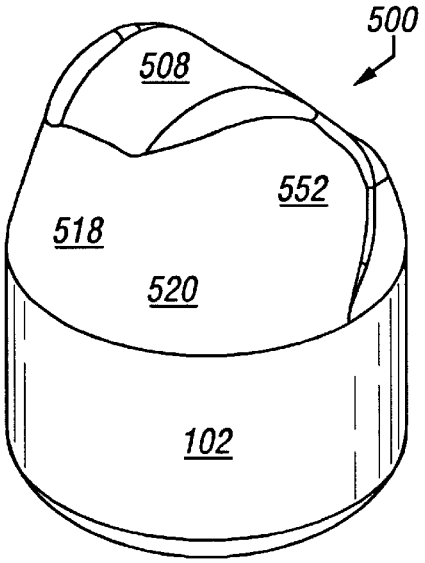
FIGS. 9A–D are perspective, plan, side and front views, respectively, of a preferred embodiment of a novel cutter element in an as-new condition.
Figure 9B:
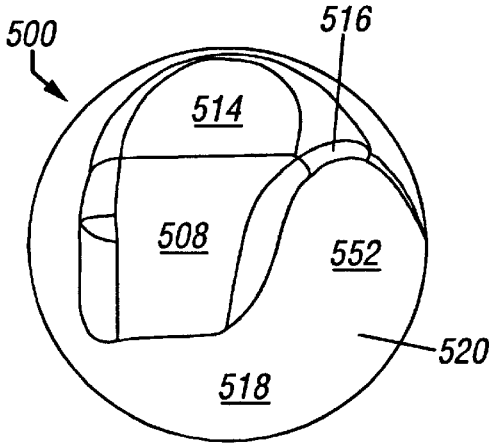
Figure 9C:
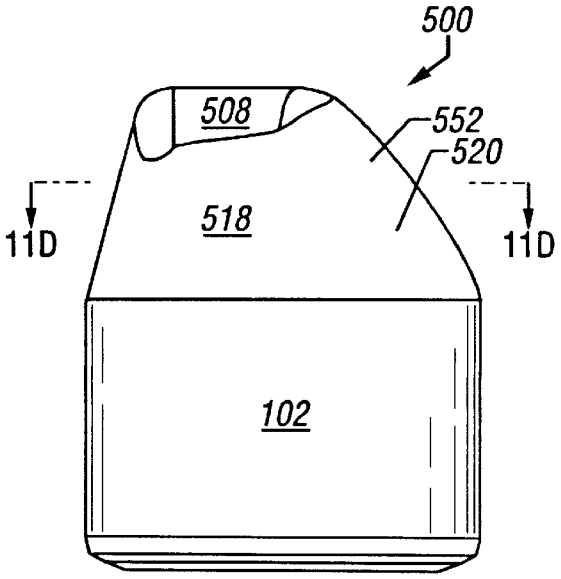
Figure 9D:
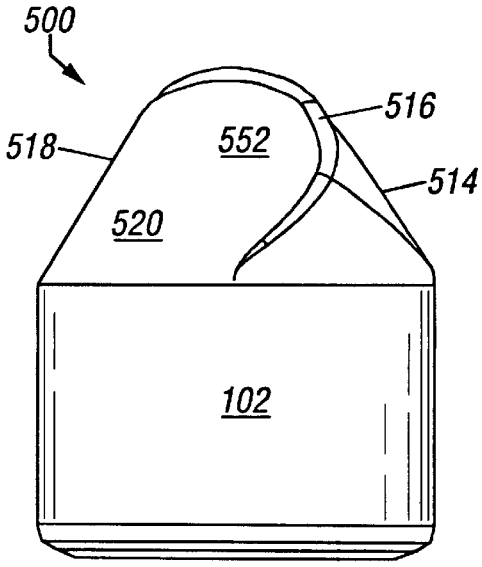
Figure 10A:
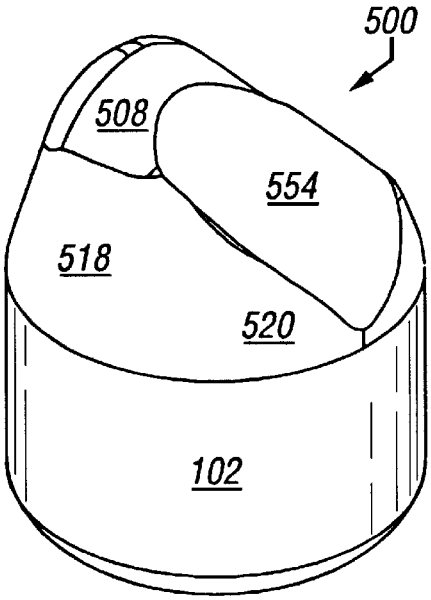
FIGS. 10A–D are perspective, plan, side and front views, respectively, of the novel cutter element of FIGS. 9A–D in a worn condition.
Figure 10B:
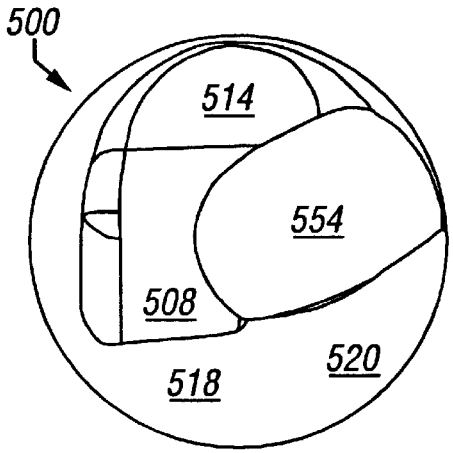
Figure 10C:
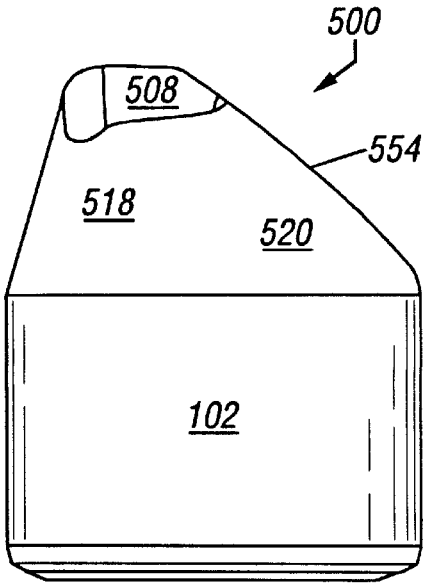
Figure 10D:
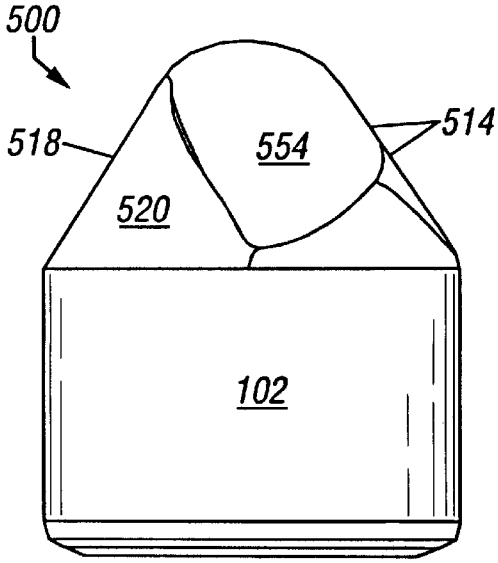

Referring now to FIG. 2, in conjunction with FIG. 1, each rolling cone cutter 14–16 is rotatably mounted on a pin or journal 20, with an axis of rotation 22 orientated generally downwardly and inwardly toward the center of the bit. Drilling fluid is pumped from the surface through fluid passage 24 where it is circulated through an internal passageway (not shown) to nozzles 18 (FIG. 1). Each cutter 14–16 is typically secured on pin 20 by locking balls 26. In the embodiment shown, radial and axial thrust are absorbed by roller bearings 28, 30, thrust washer 31 and thrust plug 32; however, the invention is not limited to use in a roller bearing bit, but may equally be applied in a friction bearing bit. In such instances, the cones 14, 15, 16 would be mounted on pins 20 without roller bearings 28, 30. In both roller bearing and friction bearing bits, lubricant may be supplied from reservoir 17 to the bearings by apparatus that is omitted from the figures for clarity. The lubricant is sealed and drilling fluid excluded by means of an annular seal 34.

The borehole created by bit 10 includes sidewall 5, corner portion 6 and bottom 7, best shown in FIG. 2. Referring still to FIGS. 1 and 2, each rolling cone cutter 14–16 includes a backface 40 and nose portion 42 spaced apart from backface 40. Rolling cones 14–16 each further include a frustoconical surface 44 that is adapted to retain cutter elements that scrape or ream the sidewall of the borehole as rolling cone cutters 14–16 rotate about the borehole bottom. Frustoconical surface 44 will be referred to herein as the "heel" surface of rolling cones 14–16, it being understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the rolling cutters rotate about the borehole. Conical surface 46 typically includes a plurality of generally frustoconical segments 48 (FIG. 1) generally referred to as "lands" which are employed to support and secure the cutter elements as described in more detail below. Grooves 49 (FIG. 1) are formed in cone surface 46 between adjacent lands 48. Frustoconical heel surface 44 and conical surface 46 converge in a circumferential edge or shoulder 50. Although referred to herein as an "edge" or "shoulder," it should be understood that shoulder 50 may be contoured, such as a radius, to various degrees such that shoulder 50 will define a contoured zone of convergence between frustoconical heel surface 44 and the conical surface 46.

In the embodiment of the invention shown in FIGS. 1 and 2, each rolling cone cutter 14–16 includes a plurality of wear resistant inserts 60, 70, 80. Inserts 60, 70, 80 include generally cylindrical base portions that are secured by interference fit into mating sockets drilled into the lands of the rolling cone cutters, and cutting portions that are connected to the base portions and have cutting surfaces that extend from cone surfaces 44, 46 and 50 for cutting formation material. The present invention will be understood with reference to one such rolling cone cutter 14, cones 15, 16 being similarly, although not necessarily identically, configured.

As best shown in FIG. 1, rolling cone cutter 14 includes a plurality of heel row inserts 60 that are secured in a circumferential row 60*a* in the frustoconical heel surface 44. Cutter 14 preferably also includes a circumferential row 70*a* of nestled inserts 70 secured to cutter 14 in locations along or near the circumferential shoulder 50, a circumferential row 80*a* of gage inserts 80 secured to cutter 14 and a plurality of inner row inserts 81, 82, 83 secured to cone surface 46 and arranged in spaced-apart inner rows 81*a*, 82*a*, 83*a*, respectively. As used herein, cutter elements 70 are referred to as "nestled" because of their mounting position relative to the position of gage cutter elements 80, in that one or more cutter elements 70 is mounted in cone 14 between a pair of cutter elements 80 that are adjacent to one another in gage row 80*a*.

As understood by those skilled in this art, heel inserts 60 and nestled inserts 70 generally function to scrape or ream the borehole sidewall 5 to maintain the borehole at full gage and prevent erosion and abrasion of heel surface 44. Gage inserts 80 function primarily to cut the corner of the borehole, in that they cut both the sidewall and the bottom of the hole. Cutter elements 81, 82 and 83 of inner rows 81*a*, 82*a*, 83*a* do not extend to full gage and are employed primarily to gouge and remove formation material from the borehole bottom 7. Inner rows 81*a*, 82*a*, 83*a* are arranged and spaced on rolling cone cutter 14 so as not to interfere with the inner rows on each of the other cone cutters 15, 16.

The American Petroleum Institute ("API") has established standards that define nominal bit diameters. According to those standards, a bit will be classified as having a particular nominal gage diameter if the bit's actual diameter falls with specified maximums and minimums as established by API for the given nominal diameter. As used herein, for a bit having a given nominal gage diameter, cutter elements will have cutting surfaces that are "on gage" or that extend to "full gage" when the radially outermost point on the cutting path of the cutter element is within the maximum and minimum limits set by API for that given nominal gage diameter.

Referring now to FIGS. 3A–D, prior art gage row inserts, or cutter elements, 100 have typically been manufactured so as to be symmetrical, without regard to the difference between the operational demands on their leading and trailing sections. Even though certain prior art inserts were described as "asymmetrical," they typically included at least a plane of symmetry between their leading and trailing portions. In contrast, the preferred embodiment of the present invention is a nonsymmetrical cutter element, meaning one that has no plane of symmetry at all. It will be understood by those skilled in the art that the features and principles of the present invention that are described herein in terms of a gage cutter, can also be applied to cutter elements in nestled or inner rows.

Figure 11A:
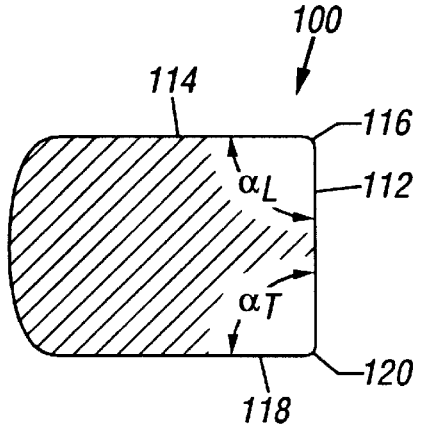
FIG. 11A (Prior Art)
FIGS. 11A–F are cross-sectional views of alternative embodiments of the present cutter element, namely.

Still referring to FIGS. 3A–D, each cutter element 100 typically has a cylindrical base portion 102 and a cutting surface 104. It should be noted that the base 102 is made in cylindrical form largely because it is the most practical. Other shapes of bases and corresponding sockets could be formed, but since it is more economical to drill circular holes in the cone for receiving base portion 102 of cutter element 100, cylindrical bases are generally preferred. The cutting surface 104 includes a crest 108, a leading face 114, a wear face 112 and a trailing face 118. Crest 108 includes an inner end 106 and a outer end 110. Between leading face 114 and wear face 112 is a leading edge 116 and between wear face 112 and trailing face 118 is a trailing edge 120. FIG. 11A shows a cross section of the cutter element of FIGS. 3A–D taken along lines 11A—11A of FIG. 3C. Many of the Figures herein attempt to depict three-dimensional surfaces and the intersections of such surfaces in a manner that can be easily interpreted. For this reason, lines have been drawn between the various surfaces. It will be understood that these lines do not represent edges and that in fact many of the surfaces shown are without edges. Therefore, discussion of contoured surfaces relates to the mathematical blending of one curve into another.

Portions of leading face 114, wear face 112, leading edge 116 and outer end 110 collectively make up a leading transition 122. Similarly, portions of trailing face 118, wear face 112, trailing edge 120 and outer end 110 collectively make up a trailing transition 124. It should be understood that the terms "leading transition" and "trailing transition" do not refer to any particularly delineated sections of the cutting surface 104, but rather to those portions in which the borehole wall-induced compressive and tensile stresses in the direction of cutting movement, respectively, are most highly concentrated. Moreover, the precise size and position of the leading and trailing transitions may vary, depending on the wellbore, bit design and other factors.

During operation, the wear face 112 is the portion of the cutter element that engages the borehole wall and is therefore subjected to greater wear than other areas of the cutter surface 104. In the course of drilling, leading transition 122 engages the borehole wall in front of trailing transition 124 for most of the cutting cycle. As a result, the trailing transition 124 of the cutter does not actively engage in shearing or reaming of the borehole wall and is subjected to significantly less compressive stresses in the direction of cutting movement than is the leading transition 122. Instead, as a result of frictional contact with the borehole wall, the trailing transition 124 is subjected to loading causing high tensile stress in the direction of cutting movement. Cutter elements are better able to withstand compressive stresses than tensile stresses. Therefore, a cutter element is more likely to fail or degrade in the trailing transition 124, which is subjected to higher tensile stresses in the direction of cutting movement than the leading transition.

The failure mode of cutter elements usually manifests itself as either breakage, wear, or mechanical or thermal fatigue. Wear and thermal fatigue are typically results of abrasion as the elements act against the formation material. Breakage, including chipping of the cutter element, typically results from impact loads, although thermal and mechanical fatigue of the cutter element can also initiate breakage. The trailing edge of prior art inserts is subjected to a combination of abrasive wear, frictional heat, impact forces and cyclic tensile stress from the cutting action. On cemented tungsten carbide inserts, the frictional heat combined with rapid cooling by the drilling fluid can lead to thermal fatigue, initiating a network of micro cracks on the surface. Cyclic tensile stresses in the direction of cutting movement on the unsupported trailing edge cause the cracks to propagate by mechanical fatigue leading to chipping or breakage. Prior art cemented tungsten carbide inserts coated with polycrystalline diamond (PCD) are prone to chipping and breakage of the trailing portion due to impact forces and tensile stresses from the cutting action.

FIGS. 4A–D depict the prior art cutter element 100 of FIGS. 3A–D as they would appear following a significant period of wear from drilling. The wear face 112 has worn away and become larger overall, having abraded portions of crest 108 and leading and trailing faces 114, 118. Due to tensile stress induced in the direction of cutting movement upon the trailing transition 124 of the wear face 112, cracks 130 have developed in the trailing transition 124. With time, these cracks will propagate deeper into the structure of the cutter element and will eventually lead to chipping and ultimately to catastrophic failure of the cutter element, thereby reducing the bit's ability to sustain its ROP or maintain gage.

Figure 11B:
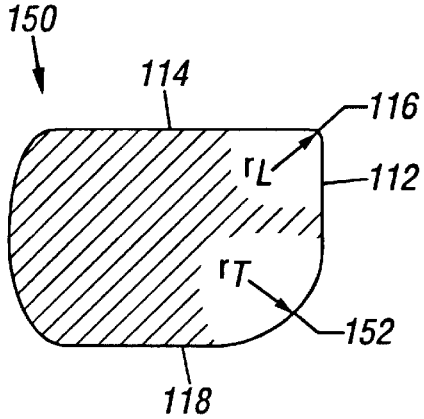

Referring now to FIGS. 5A–D, 6A–D and 11B, a first embodiment of a cutter element 150 is constructed in accordance with the present invention so as to substantially reduce the tensile stresses in the direction of cutting movement and the associated failure in the trailing transition. In FIGS. 5A–5D and 6A–6D, as well as subsequent figures, components and elements common to the cutter element 100 will be designated with like reference numerals and changes in the design of like-numbered components will be described. FIG. 11B shows a cross section of the cutter element of FIGS. 5A–D taken along lines 11B—11B of FIG. 5C.

Cutter element 150 includes a cylindrical base 102 and a cutting surface 104. The cutting surface 104 includes crest 108 having an inner end 106 and an outer end 110. Like the conventional cutter element 100, the cutter element 150 features a wear face 112, leading face 114, leading edge 116 trailing face 118 and leading and trailing transitions 122, 152, respectively. Unlike cutting element 100, however, the novel cutter element 150 includes a more rounded, relieved or chamfered trailing transition 152 as compared to the trailing edge 120 and trailing transition 124 on conventional cutter element 100 (FIG. 3). As used herein to describe a portion of a cutter element's cutting surface, the term "sharper" indicates that either (1) the angle defined by the intersection of two lines or planes or (2) the radius of curvature of a curved surface, is smaller than a comparable measurement on the portion of cutting surface to which it is compared, or a combination of features (1) and (2). Eliminating abrupt changes in curvature or small radii between adjacent regions lessens undesirable areas of high stress concentrations which can cause or contribute to premature cutter element breakage. As a result of the rounding off of trailing transition 152 as shown, the leading edge 116 of cutter element 150 is sharper than trailing transition 152.

It is preferred that the trailing transition 152 be contoured such that, the trailing portion of the cutting surface remains substantially free of sharp surface transitions. In addition, or alternatively, the leading transition 122 may have a sharp leading edge 116 so as to optimize cutting efficiency of the borehole sidewall. However, depending upon the formation being drilled, the leading transition 122 may also be contoured so as to improve the durability of the cutting edge. As used herein, the terms "contoured" or "sculpted" refer to cutting surfaces that can be described as continuously curved surfaces wherein relatively small radii (typically less than 0.080 inches) are not used to break sharp edges or round-off transitions between adjacent distinct surfaces as is typical with many conventionally-designed cutter elements. It will be understood that the transitions 122, 152 need not be contoured, and that trailing transition 152 can be chamfered or shaved so as to achieve a result similar to the contouring shown, in that the trailing transition will not be as sharp as the leading transition. Furthermore, it will be understood that, although the Figures depict faces that include substantially planar portions, all of the faces and surfaces of the cutter element of the present invention can be rounded so as to be convex, concave, or have various other non-planar configurations.

Referring particularly to FIGS. 6A–D, it can be seen that when the wear face 112 of a cutter element such as 150 is worn, significantly less of the contoured trailing transition 152 is subject to tensile stress in the direction of cutting movement, with the result that trailing portions of the cutter element are less likely to fail.

Figure 1A:
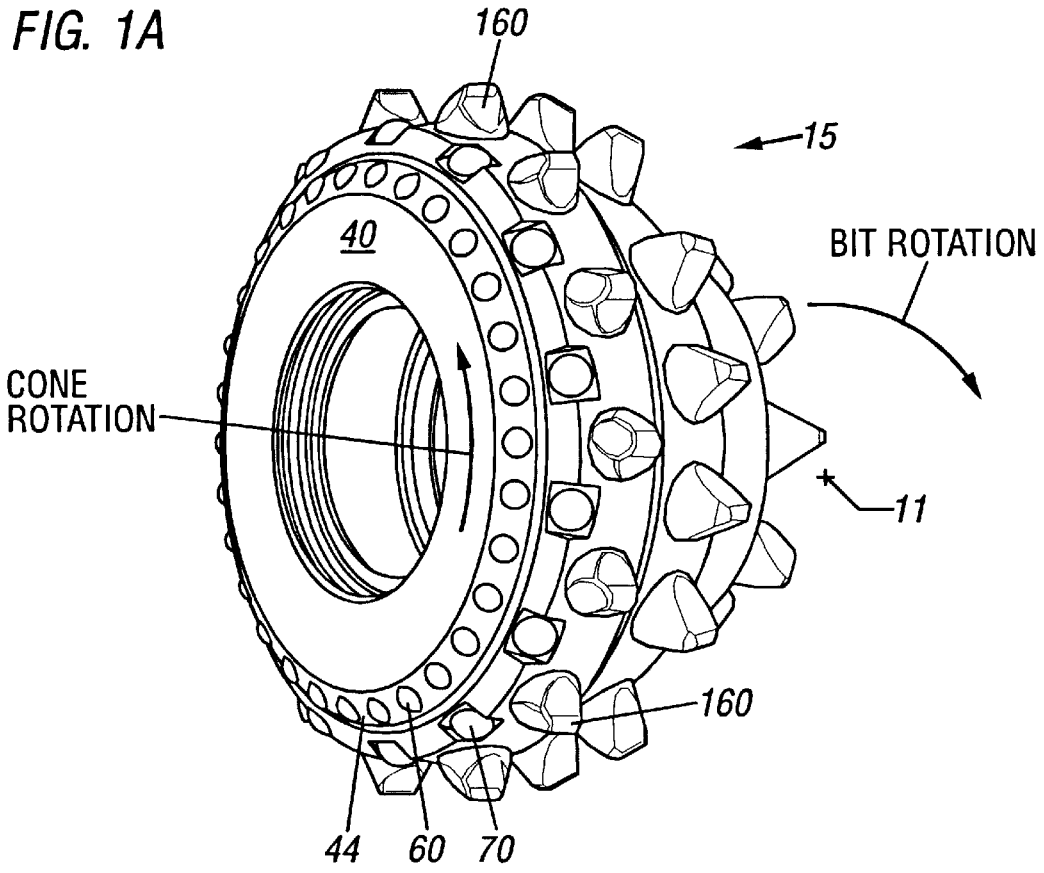
FIG. 1A is perspective view of a rolling cone cutter of the bit shown in FIG. 1 as viewed along the bit axis from the pin end of the bit.
Figure 1B:
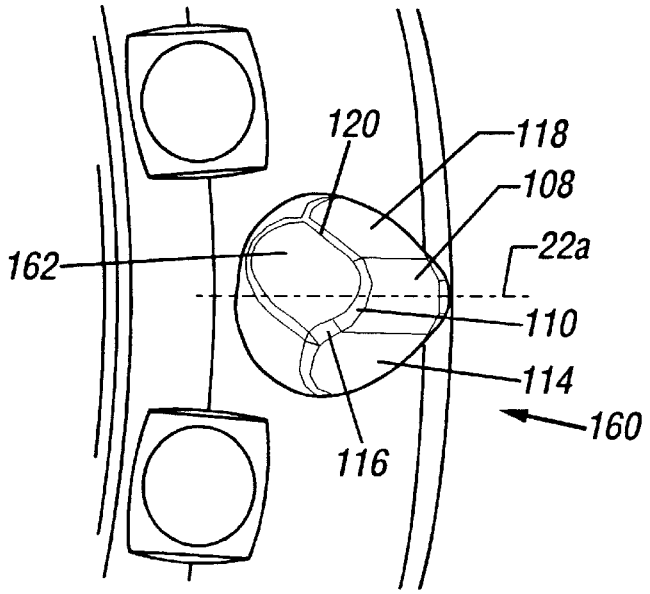
FIG. 1B is an enlarged view of a single cutter element from FIG. 1A, showing a preferred orientation of the wear face and the leading and trailing edges of the cutter element of the present invention.
Figure 11C:
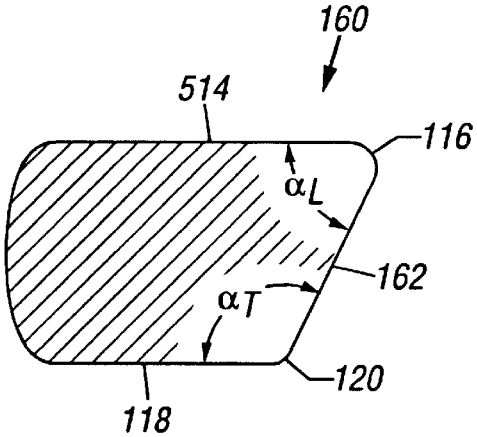

Referring now to FIGS. 7A–D and 8A–D, a second preferred embodiment of the cutter element of the present invention is shown. FIG. 11C shows a cross section of the cutter element of FIGS. 7A–D taken along lines 11C—11C of FIG. 7C. This nonsymmetrical cutter element 160 is different from that shown in FIGS. 3A–D in that it has a wear face 162 which is canted or relieved away from the borehole wall and in the direction of trailing face 118, such that the trailing edge experiences less frictional engagement with the borehole wall than prior art cutter elements, and therefore also experiences less tensile stresses in the direction of cutting movement. As with machine cutting tools, this relieving of the wear face towards the trailing side is essentially a back relief to substantially reduce tensile stress induced failures. As shown in FIGS. 1A and 1B, cutter element 160 is positioned such that wear face 162 slopes away from the borehole sidewall. That is, the cutter element 160 is positioned such that trailing edge 120 of the cutting surface is closer to the bit axis than leading edge 116 with the cutter element's crest 108 being substantially aligned with the cone axis. In this manner, the relief obtained is due to specific changes in the cutter element geometry, and is beyond any such relief that may be inherent due to bit offset as created by having the cone axis skewed with respect to the bit axis. Referring particularly to FIGS. 8A–D, it can be seen that when an insert 160 having the relieved wear face 162 experiences wear, a trailing portion 164 of the wear face 162 remains untouched, therefore minimizing tensile stress in the direction of cutting movement. The new edge formed between trailing portion 164 and wear face 162 is less vulnerable to tensile stresses in the direction of cutting movement because the inside angle between trailing portion 164 and wear face 162 is relatively obtuse. By shifting the trailing portion of the cutter element that is subjected to detrimental tensile stresses in the direction of cutting movement away from the borehole wall, the trailing portions of the cutter element are less likely to fail.

According to this preferred embodiment, when cutter element 160 is used in a gage row 80*a*, crest 108 is substantially aligned with a projection 22*a* of cone axis 22 as illustrated in FIG. 1A, although this is not necessary. For ease of reference, a linear, or straight crest is discussed in terms of its alignment with the cone axis. It will be understood, however, that the principles of the present invention can be used in conjunction with cutter elements having non-linear crests and/or crests that are not substantially aligned with the projection of the cone axis.

In the embodiment shown in FIGS. 7A–D and 8A–D, the relative sharpness of the leading transition as compared to the trailing transition is manifest in the relative magnitudes of inside angles $\alpha_L$ and $\alpha_T$, which measure the angles between wear face 162 and leading face 114 and between wear face 162 and trailing face 118, respectively, and are best shown in FIG. 11C. Angles $\alpha_L$ and $\alpha_T$, can vary, depending on bit design considerations, so long as $\alpha_T$ is greater than $\alpha_L$. It will be further understood that the present invention does not require that both transitions be rounded, or both angled, so long as the leading transition is sharper than the trailing transition.

Referring now to FIGS. 9A–D, 10A–D and 11D, a fully contoured cutter element 500 manifesting the most preferred features of the present invention includes a crest 508, a leading face 514, a canted wear face 552 and a curved trailing face 518. Between leading face 514 and wear face 552 is a leading edge 516 and between wear face 552 and trailing face 518 is an extremely rounded trailing edge 520. When the cutter element of FIGS. 9A–D is worn, an asymmetrical wear flat 554 is abraded on wear face 552 and the result approximates FIGS. 10A–D. As can be seen, the asymmetry between the leading and trailing portions of cutter element 500 is severe, allowing the primary purpose of providing a well-supported wear face 552 in which the trailing portion is subject to less tensile stress in the direction of cutting movement.

Figure 11D:
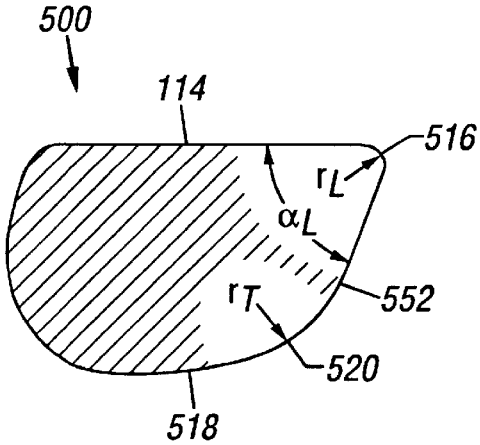
Figure 11E:
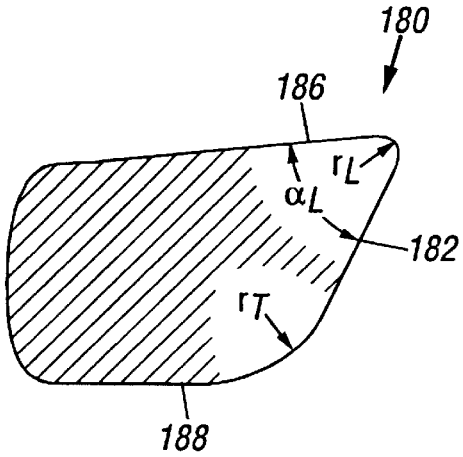

Referring now to FIGS. 11A–D, cross-sectional views of the cutter elements described above are shown side-by-side for ease of comparison. As depicted in FIG. 11A, conventional cutter element 100 provides a symmetrical profile in which the leading and trailing inside angles $\alpha_L$ and $\alpha_T$ are the same and the radii of curvature of the leading and trailing transitions, if any, are the same. As depicted in FIG. 11B, cutter element 150 has an rounded or contoured trailing edge 152 having a radius of curvature $r_T$ greater than the radius of curvature $r_L$ of leading transition 116. As depicted in FIG. 11C, cutter element 160, with its canted or relieved wear face 162, provides a nonsymmetrical profile in which $\alpha_T$ is greater than $\alpha_L$. As depicted in FIG. 11D, a preferred embodiment of the present cutter element 500 includes both a contoured trailing edge 520 and a canted or relieved wear face 552, resulting in a nonsymmetrical profile.

Figure 11F:
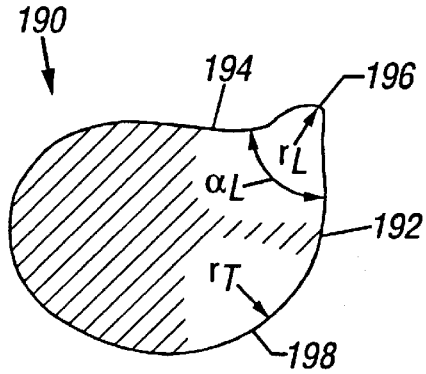
Figure 11G:
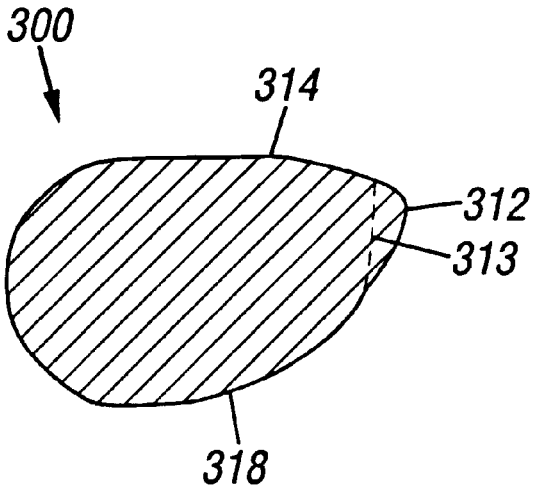
Figure 11H:
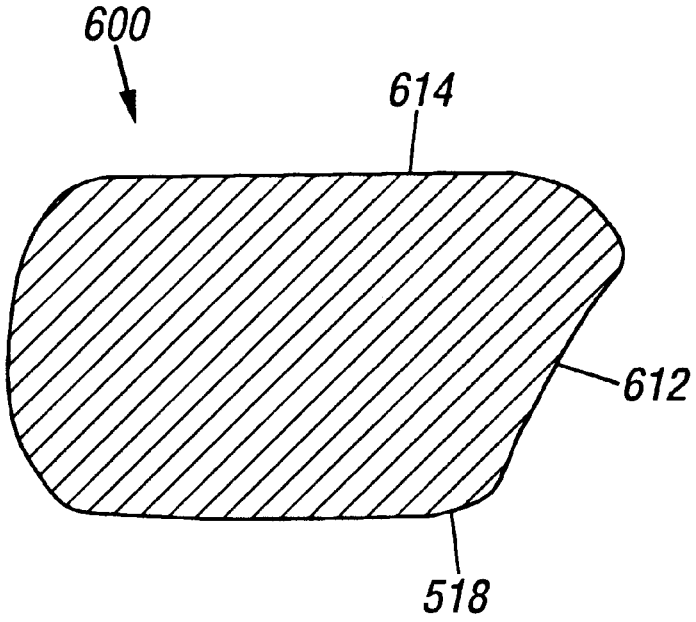

It will be understood that more or less aggressive rake angles and greater or lesser differentiation between the relative sharpness of the leading and trailing sections can be used on the present cutter element without departing from the spirit of the present invention. By way of example only, additional comparable cross-section 11E shows a cutter element 180 having a relieved wear face 182, an extremely rounded trailing face 188, and a positive rake angle on the leading edge 186. Comparable FIG. 11F shows a cutter element 190 having a relieved wear face 192, a positive rake angle on its leading edge 196, an extremely rounded trailing face 198 and a recessed leading face 194. Similarly, FIG. 11G shows a cross section of cutter element 300 having leading face 314 with slightly negative rake, an extremely rounded trailing face 318, and a relatively small wear face 312 therebetween. Upon wear, the size of wear face 312 will increase as represented by line 313 which shows wear face 312 in a partially worn condition. FIG. 11H shows cutter element 600 having leading face 614, trailing face 618 and a relieved and concave wear face 612.

Furthermore, the present invention may be employed in steel tooth bits as well as TCI bits. Steel tooth bits have particular application in relatively soft formation materials and are preferred over TCI bits in many applications. Nevertheless, even in relatively soft formations, in prior art bits in which the gage row cutter elements consisted of steel teeth with hard metal coatings, the substantial sidewall cutting that must be performed by such steel teeth may cause the teeth to wear to such a degree that the bit becomes undersized and cannot maintain gage. The benefits and advantages of the present invention that were previously described with reference to a TCI bit applies equally to steel tooth bits, as the inventive cutter elements reduce the effects of tensile stress on the cutter elements. The cutter element of the present invention can also be used advantageously in the nestled and off-gage positions as described in the copending applications referred to below.

Figure 12I:
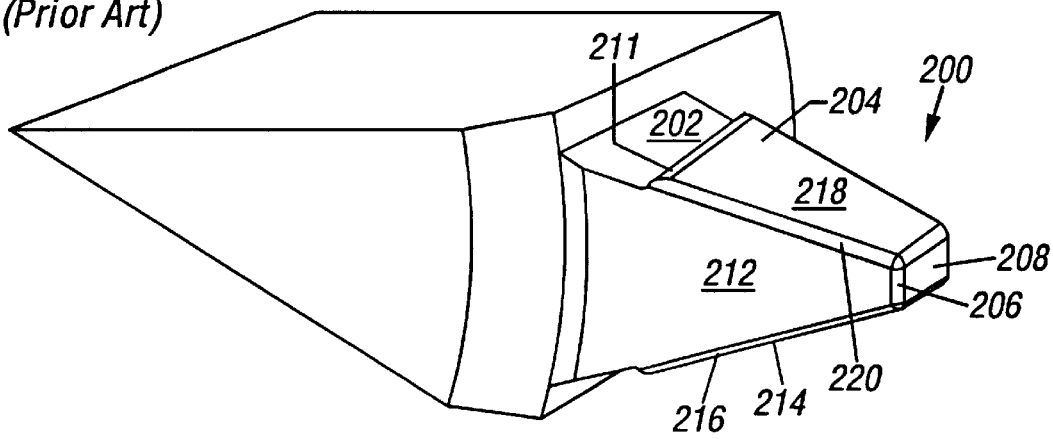
FIG. 12(i) (Prior Art)
FIG. 12(i) is a perspective view of a prior art cutter element for a steel tooth bit.
Figure 12:
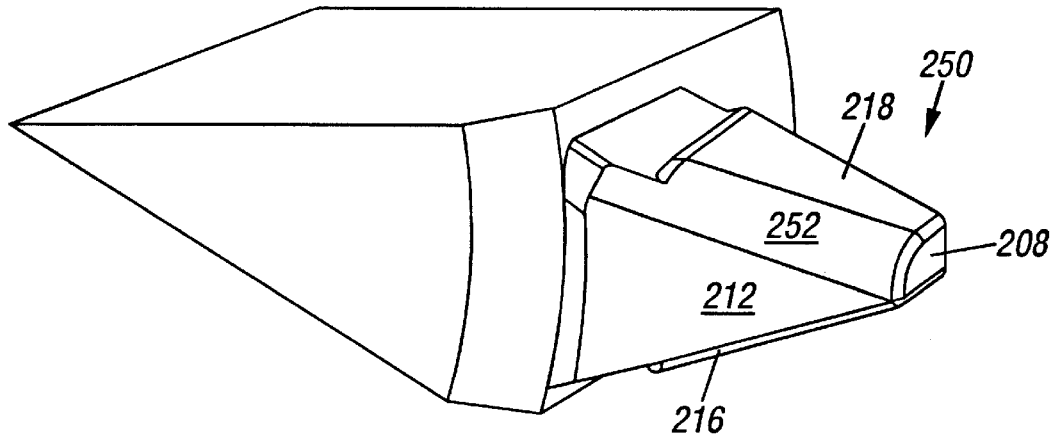
FIGS. 12(ii)–(iii) are perspective views of alternative embodiments of a tooth for a steel tooth bit configured in accordance with the present invention.
Figure 13I:
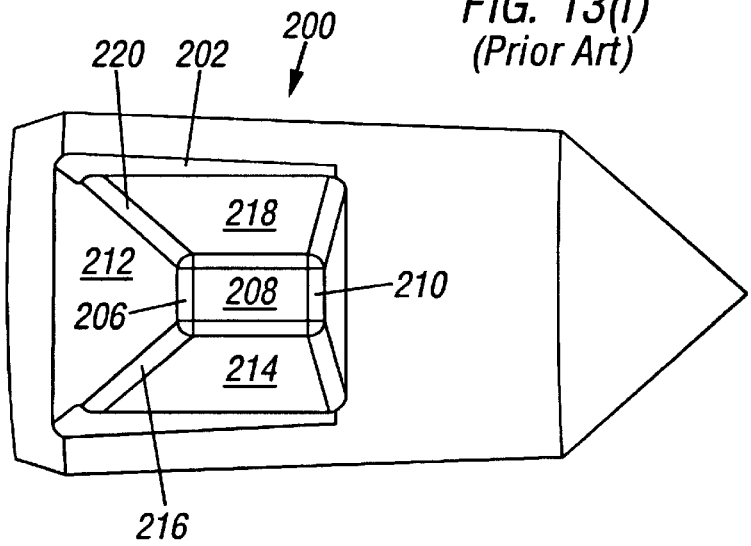
FIG. 13(i) (Prior Art)
FIG. 13(i) is a plan view of the prior art cutter element of FIG. 12(i)
Figure 13:
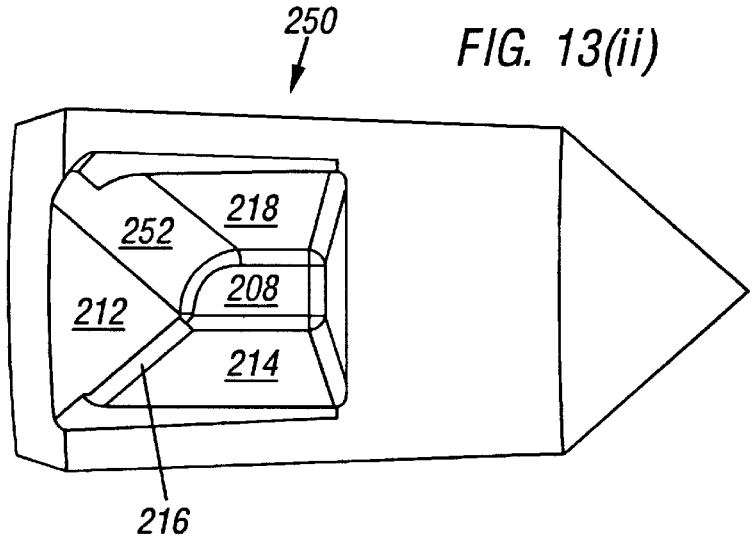
FIGS. 13(ii)–(iii) are plan views of the alternative steel tooth embodiments shown in FIGS. 12(ii)–(iii), respectively.

Referring now to FIGS. 12(ii)–(iii) and 13(ii)–(iii), the novel principles described above with respect to tungsten carbide inserts are shown as applied to steel tooth bits. By way of contrast, FIGS. 12(i) and 13(i) show a conventional tooth 200 having a steel base 202 and an overlying layer of hardfacing 204 generally following the contours of the underlying steel such as is known in the art. Tooth 200 includes a crest 208, a leading face 214, a wear face 212 and a trailing face 218. Crest 208 includes an outer end 206 and an inner end 210. Between leading face 214 and wear face 212 is a leading edge 216 and between wear face 212 and trailing face 218 is a trailing edge 220. It will be understood that the edges of hardfacing 204 form shoulders 211 on leading and trailing faces 214, 218, and that wear face 212 may be ground to a controlled form during manufacturing so that the outer surface of hardfacing 204 is dimensionally controlled to conform to API bit gaging tolerances. Other configurations of hardfacing are known and may be used without departing from the spirit of the present invention.

In FIGS. 12(i) and 13(i), as in FIGS. 3A–D, the leading and trailing sections of the prior art tooth are symmetrical. Consequently, trailing edge 220 tends to fail more rapidly than leading edge 216.

In FIGS. 12(ii) and 13(ii), as in FIGS. 5A–D, tooth 250 is nonsymmetrical and includes a trailing edge 252 that is not as sharp as leading edge 216. In the embodiment depicted, trailing edge 252 is rounded and is made less sharp, preferably by increasing the radius of curvature of the underlying steel of the tooth. Nevertheless, it will be understood that trailing edge 252 could alternatively be chamfered.

In FIGS. 12(iii) and 13(iii), as in FIGS. 7A–D, tooth 260 is also nonsymmetrical and includes a relieved wear face 262. Relieving wear face 262 has the effect of increasing the inside angle between wear face 262 and trailing face 218 and decreasing the inside angle between wear face 262 and leading face 214 (as compared to prior art tooth 200 of FIG. 12(i), 13(i)), with the result that trailing edge 220 is not as sharp as leading edge 216. As with the tungsten carbide inserts described above, the features of rounding off the trailing edge, or relieving the wear face can also be used in combination with each other or with other performance-enhancing features to improve operability of the steel tooth bit.

The present invention addresses the above failure modes by significantly reducing the tensile stresses in the direction of cutting movement on the trailing transition of a cutter element. In addition, the new geometry of the trailing section provides structural support to better enable the cutter element to withstand impact forces and tensile stresses that result from the cutting action. Due to a lesser area being presented to the formation, the frictional heat is less and therefore the potential of thermal fatigue is reduced. Even if thermal fatigue should occur, the new geometry of the present insert is better suited to withstand the mechanical loading that causes chipping and breakage. The new and improved geometry of the trailing portion provides increased opportunities for cutter elements coated with superabrasives such as PCD or CBN, since the principal factors that cause the superabrasive coating to fail are greatly reduced.

A particularly preferred embodiment of the present invention includes use of described cutter elements as gage, off-gage or inner row cutter elements in a bit which has disposed cutter elements to perform separate sidewall, corner and bottom hole cutting duty. A bit of this sort is disclosed and described in the commonly owned copending application filed on Apr. 10, 1996, Ser. No.: 08/630,517, and entitled Rolling Cone Bit with Gage and Off-gage Cutter Elements Positioned to Separate Sidewall and Bottom Hole Cutting Duty; copending application Ser. No. 08/667,758 filed Jun. 21, 1996 entitled Rolling Cone Bit with Enhancements in Cutter Element Placement and Materials to Optimize Borehole Corner Cutting Duty; and copending application Ser. No. 60/020,239 (Provisional) filed Jun. 21, 1996 entitled Rolling Cone Bit Having Gage and Nestled Gage Cutter Elements Having Enhancements in Materials to Optimize Borehole Corner Cutting Duty, which are hereby incorporated by reference as if fully set forth herein. The cutter elements of the present invention, having a relatively sharper leading section and relatively less sharp trailing section, can be used advantageously in place of any one or more of gage cutter elements, nestled cutter elements, off-gage row cutter elements, steel tooth cutter element or inner row cutter elements described in the copending applications.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. A shaped insert for use in a cone of a rolling cone drill bit, comprising:

a base portion;

a cutting surface extending from said base portion, said cutting surface including a leading face, a trailing face, and a wear face having leading and trailing sections, said leading face and said trailing face defining a crest therebetween, said leading face and said leading section defining a leading transition therebetween and said trailing face and said trailing section defining a trailing transition therebetween;

wherein said leading transition is sharper than said trailing transition.

2. The insert according to claim 1 wherein at least one of said leading and trailing transitions is contoured.

3. The insert according to claim 2 wherein said wear face is nonplanar.

4. The insert according to claim 3 wherein each of said leading and trailing faces is contoured.

5. The insert according to claim 4 wherein the entire cutting surface of said insert is contoured.

6. The insert according to claim 1 wherein each of said leading and trailing transitions comprises a radius of curvature and wherein the radius of curvature of said leading transition is smaller than the radius of curvature of said trailing transition.

7. The insert according to claim 1 wherein said wear face and said leading face generally intersect in a first angle of intersection and said wear face and said trailing face generally intersect in a second angle of intersection and wherein said first angle of intersection is less than said second angle of intersection.

8. The insert according to claim 7 wherein said wear face is substantially planar.

9. The insert according to claim 1 wherein said cutting surface is nonsymmetrical.

10. The insert according to claim 9 wherein at least a portion of said cutting surface is coated with a superabrasive.

11. The insert according to claim 9 wherein said cutting surface is entirely coated with a superabrasive.

12. The insert according to claim 9 wherein said entire cutting surface is contoured.

13. The insert according to claim 1 wherein said crest lies substantially parallel to a projection of the axis of the rolling cone.

14. The insert according to claim 1 wherein said crest is skewed with respect to a projection of the axis of the rolling cone.

15. An earth boring bit for drilling a borehole having a predetermined gage diameter, the bit comprising:

a bit body having a bit axis;

at least one rolling cone rotatably mounted on said bit body and having an axis, a generally conical surface, a frustoconical heel surface adjacent said conical surface, and a circumferential shoulder between said conical and heel surfaces;

a first plurality of cutter elements on said cone having cutting surfaces that extend to full gage;

a second plurality of cutter elements on said cone having cutting surfaces that do not extend to full gage;

at least a given one of said cutter elements comprising a base and a nonsymmetrical cutting surface extending from said base, said cutting surface including a leading face, a trailing face and a wear face having leading and trailing sections, said leading face and said trailing face defining a crest therebetween;

wherein said leading face and said leading section define a leading transition therebetween, and said trailing face and said trailing section define a trailing transition therebetween; and wherein said leading transition is sharper than said trailing transition.

16. The bit according to claim 15 wherein said nonsymmetrical cutting surface of said given cutter element extends to full gage.

17. The bit according to claim 16 wherein said given cutter element is mounted in a nestled row of cutter elements mounted adjacent to said shoulder of said cone.

18. The bit according to claim 16 wherein said given cutter element is mounted on said conical surface of said cone.

19. The bit according to claim 15 wherein said nonsymmetrical cutting surface of said given cutter element does not extend to full gage.

20. The bit according to claim 19 wherein said given cutter element is mounted in a nestled row of cutter elements mounted adjacent to said shoulder of said cone.

21. The bit according to claim 19 wherein said given cutter element is mounted on said conical surface of said cone.

22. The bit according to claim 15 wherein said given cutter element has a cutting surface that is contoured.

23. The bit according to claim 15 wherein said cutting surface of said given cutter element includes at least a portion having a polycrystalline diamond coating.

24. The bit according to claim 15 wherein said crest of said given cutter element is substantially aligned with the projection of the cone axis.

25. The bit according to claim 15 wherein said wear face of said given cutter element is relieved away from the borehole wall.

26. The bit according to claim 15 wherein said crest of said given cutter element is nonlinear.

27. The bit according to claim 15 wherein said leading face has a positive rake angle.

28. The bit according to claim 15 wherein said leading face has a negative rake angle.

29. A steel tooth bit for drilling a borehole, comprising:

a bit body;

at least one cone cutter rotatably mounted on said bit body; at least one cutter element formed integrally with said cone cutter, said cutter element having a cutting surface comprising a leading face, a trailing face and a wear face therebetween, said wear face and said leading face defining a leading transition therebetween and said wear face and said trailing face defining a trailing transition therebetween; and wherein said leading and trailing transitions each comprise a corner having a radius of curvature, and wherein the radius of curvature of said leading transition is smaller than the radius of curvature of said trailing transition such that said leading transition is sharper than said trailing transition.

30. The bit according to claim 29 wherein said crest is parallel to a projection of the cone axis.

31. The bit according to claim 29 wherein said wear face is canted with respect to the borehole wall.

32. A steel tooth bit for drilling a borehole, comprising:

a bit body;

at least one cone cutter rotatably mounted on said bit body;

at least one cutter element formed integrally with said cone cutter, said cutter element having a cutting surface comprising a leading face, a trailing face and a wear face therebetween, said wear face and said leading face defining a leading transition therebetween and said wear face and said trailing face defining a trailing transition therebetween; and wherein said trailing transition is chamfered such that said leading transition is sharper than said trailing transition.

33. The bit according to claim 32 wherein said wear face is canted with respect to the borehole wall.

34. The bit according to claim 32 wherein said crest is parallel to a projection of the cone axis.

35. The bit according to claim 32 wherein said cutting surface extends to full gage.

36. The bit according to claim 32 wherein said cutter element is disposed on said cone in an inner row.

37. A steel tooth bit for drilling a borehole, comprising:

a bit body;

at least one cone cutter rotatably mounted on said bit body;

at least one cutter element formed integrally with said cone cutter, said cutter element having a cutting surface comprising a leading face, a trailing face and a wear face therebetween, said wear face and said leading face defining a leading transition therebetween and said wear face and said trailing face defining a trailing transition therebetween; and wherein said wear face is canted with respect to the borehole wall such that said leading transition is sharper than said trailing transition.

38. The bit according to claim 37 wherein said trailing transition is chamfered.

39. The bit according to claim 37 wherein said leading and trailing transitions each comprise a corner having a radius of curvature, and wherein the radius of curvature of said leading transition is smaller than the radius of curvature of said trailing transition.

40. The bit according to claim 37 wherein said crest is parallel to a projection of the cone axis.

41. The bit according to claim 37 wherein said wear face and said leading face generally intersect in a first angle of intersection and said wear face and said trailing face generally intersect in a second angle of intersection and wherein said first angle of intersection is less than said second angle of intersection.

42. The bit according to claim 37 wherein said trailing transition is contoured.

43. The bit according to claim 37 wherein said cutting surface extends to full gage.

44. The bit according to claim 37 wherein said cutter element is disposed on said cone in an inner row.

45. An earth boring bit for drilling a borehole having a predetermined gage diameter, the bit comprising:

a bit body having a bit axis;

at least one rolling cone rotatably mounted on said bit body and having an axis, a generally conical surface, a fustoconical heel surface adjacent said conical surface, and a circumferential shoulder between said conical and heel surfaces;

at least one cutter element mounted on said cone cutter having a nonsymmetrical cutting surface, said cutting surface including a leading face, a trailing face and a wear face therebetween, said cutter element mounted in said cone cutter with said wear face relieved from the borehole wall.

46. The bit according to claim 45 wherein said wear face is nonplanar.

47. The bit according to claim 45 wherein said leading face has a positive rake angle.

48. The bit according to claim 45 wherein said leading face and said wear face intersect in a leading transition, and wherein said trailing face and said wear face intersect in a trailing transition, and wherein said leading transition is sharper than said trailing transition.

49. The bit according to claim 48 wherein at least one of said leading and trailing transitions is contoured.

50. The bit according to claim 48 wherein each of said leading and trailing transitions comprises a radius of curvature and wherein the radius of curvature of said leading transition is smaller than the radius of curvature of said trailing transition.

51. The bit according to claim 48 wherein at least a portion of said cutting surface is coated with a superabrasive.

52. The bit according to claim 45 wherein said cutting surface is fully contoured.

53. The bit according to claim 52 wherein said cutting surface is entirely coated with superabrasive.

54. The bit according to claim 45 wherein comprising a crest between said leading and said trailing faces, wherein said crest lies substantially parallel to a projection of the axis of the rolling cone.

55. The bit according to claim 45 further comprising a crest between said leading and said trailing faces, wherein said crest is skewed with respect to a projection of the axis of the rolling cone.

56. The bit according to claim 40 wherein said cutting surface extends to full gage.

57. The bit according to claim 40 wherein said cutter element is disposed on said cone in an inner row.

* * * * *